US008116487B2

(12) United States Patent
Mori

(10) Patent No.: US 8,116,487 B2
(45) Date of Patent: Feb. 14, 2012

(54) PIEZOELECTRIC SPEAKER AND ELECTRONIC APPARATUS WITH PIEZOELECTRIC SPEAKER

(75) Inventor: Ukyo Mori, Tokyo (JP)

(73) Assignee: NEC Corporation, Tokyo (JP)

( * ) Notice: Subject to any disclaimer, the term of this patent is extended or adjusted under 35 U.S.C. 154(b) by 459 days.

(21) Appl. No.: 12/514,111

(22) PCT Filed: Nov. 5, 2007

(86) PCT No.: PCT/JP2007/071861

§ 371 (c)(1),
(2), (4) Date: May 8, 2009

(87) PCT Pub. No.: WO2008/056800

PCT Pub. Date: May 15, 2008

(65) Prior Publication Data

US 2010/0054506 A1 Mar. 4, 2010

(30) Foreign Application Priority Data

Nov. 9, 2006 (JP) ..... 2006-303455

(51) Int. Cl.
*H04R 25/00* (2006.01)

(52) U.S. Cl. ..... 381/190

(58) Field of Classification Search ..... None
See application file for complete search history.

(56) References Cited

U.S. PATENT DOCUMENTS

| | | | | |
|---|---|---|---|---|
| 4,330,729 | A * | 5/1982 | Byrne | 310/322 |
| 4,916,821 | A * | 4/1990 | Potter | 33/362 |
| 7,593,534 | B2 * | 9/2009 | Andersen | 381/67 |
| 7,764,804 | B2 * | 7/2010 | Ohta et al. | 381/190 |

FOREIGN PATENT DOCUMENTS

| | | | |
|---|---|---|---|
| JP | 1978070206 | A | 6/1978 |
| JP | 1984034222 | A | 9/1984 |
| JP | 1992047754 | A | 11/1992 |
| JP | 1998164694 | A | 6/1998 |
| JP | 2001119795 | A | 4/2001 |
| JP | 2005130156 | A | 5/2005 |

OTHER PUBLICATIONS

International Search Report for PCT/JP2007/071861 mailed Dec. 18, 2007.

* cited by examiner

*Primary Examiner* — Charles Garber
*Assistant Examiner* — Andre' C Stevenson

(57) ABSTRACT

Provided is a piezoelectric speaker (40) including: a piezoelectric element (42) that deforms in response to an input signal; a diaphragm (43) that is set in bending motion by the piezoelectric element (42) to generate sound; and a resilient portion (44) that holds at least a part of an outer edge of the diaphragm (43). The piezoelectric speaker further includes a lock portion (46) arranged to block extension of the diaphragm (43) by coming into contact with a part of a vibration plane of the diaphragm (43) when an input signal is not input to obtain a lock state and to release the lock state immediately after the input signal is input. Consequently, bending motion of the diaphragm (43) can be started quickly and movement of the diaphragm is not obstructed after starting of the bending motion.

12 Claims, 9 Drawing Sheets

PIEZOELECTRIC SPEAKER AND ELECTRONIC APPARATUS WITH PIEZOELECTRIC SPEAKER

This application is the National Phase of PCT/JP2007/071861, filed Nov. 5, 2007, which claims priority to Japanese Patent Application No. 2006-303455, filed on Nov. 9, 2006, which is incorporated herein by reference in its entirety.

TECHNICAL FIELD

This invention relates to a piezoelectric speaker using a piezoelectric element, and to an electronic apparatus equipped with the piezoelectric speaker, such as a mobile telephone, a personal digital assistant (PDA), and a portable game device.

BACKGROUND ART

A piezoelectric speaker converts an electric signal into sound using as a vibrator a piezoelectric element that deforms when a voltage is applied thereto. The sound includes an alarm, a melody, and the like, as well as voice. Hereinafter, description is made exemplifying sound as voice.

In a piezoelectric speaker, a circular piezoelectric element is attached to a diaphragm held in the piezoelectric speaker. When an electric signal is applied to the piezoelectric element, the piezoelectric element deforms in response to the applied electric signal. The electric signal to be applied has a voltage and a current changed variously depending upon an input voice signal, and thus the deformation of the piezoelectric element results in deformation motion in accordance with a change in input voice signal. The deformation motion of the piezoelectric element is transmitted to the diaphragm with the piezoelectric element attached thereto, and the vibration of the diaphragm vibrates surrounding air, whereby voice is generated.

It is desired that the diaphragm of the piezoelectric speaker have a largest possible vibration plane and be capable of vibrating freely with a largest possible amplitude. This is because, if the diaphragm is capable of vibrating largely due to a large vibration plane, voice with a large volume under a large sound pressure can be generated. Further, if the diaphragm is capable of vibrating freely, the deformation motion of the piezoelectric element is converted into vibration motion efficiently, which enables a signal input to the piezoelectric element to be reproduced more accurately.

Regarding a method of supporting a diaphragm, various methods are proposed. More specifically, a support member, a support structure, and the like of the diaphragm are proposed (see, for example, Patent Document 1: JP 2005-130156 A, Patent Document 2: JP 2001-119795 A, Patent Document 3: JP 10-164694 A).

Referring to FIG. 1, an example of a support structure of the diaphragm will be described.

In the support structure of the diaphragm shown in FIG. 1, a diaphragm 11 is supported between a housing 12 and a structural part (a cover 13) inside the piezoelectric speaker via spacers 14 and 15. By using members having appropriate elasticity such as silicone rubber, the diaphragm 11 is held at the structural part while keeping an appropriate degree of freedom.

However, when only a degree of freedom of vibration motion is pursued in the support structure of the diaphragm of the piezoelectric speaker, there arises a problem in that the sound characteristics of the piezoelectric speaker may be degraded partially. Specifically, problems such as the degradation in reproduction characteristics at a time of rising during the start of a signal input and the degradation in reproduction characteristics of a signal with a small sound pressure are caused.

Those problems are caused by the fact that the motion of the diaphragm for generating voice is reciprocating motion in a direction perpendicular to the vibration plane, whereas the deformation of the piezoelectric element is extension and contraction motion parallel to the plane of the diaphragm, and thus, those motions are in completely different directions.

Hereinafter, the mechanism of converting the extension and contraction motion of the piezoelectric element into the reciprocating motion in the direction perpendicular to the diaphragm in the piezoelectric speaker will be described.

When a voice signal is input to the piezoelectric speaker, an electric signal is applied to the piezoelectric element, and the piezoelectric element extends. When the piezoelectric element extends, the diaphragm is also extended along therewith.

Here, if the diaphragm is capable of extending by an extension amount or more of the piezoelectric element and is supported in an ideal state, and there is no factor for blocking the extension of the diaphragm, the diaphragm is extended freely in parallel with the vibration plane by the extension amount of the piezoelectric element. However, because the diaphragm is supported by the support structure, a reaction force is generated from the support structure when the diaphragm extends to some degree, whereby the extension is blocked. When the extension of the diaphragm is blocked, the motion of the diaphragm of spreading in a direction parallel to the vibration plane loses a place to go, with the result that the diaphragm starts bending. Due to the bending of the diaphragm, the extension of the piezoelectric element is converted into the motion in a direction perpendicular to the diaphragm. Once the diaphragm starts bending, the motion of the diaphragm gains momentum as the bending motion, and the extension and contraction motion of the piezoelectric element thereafter is converted into the bending motion of the diaphragm to become vibration motion.

In the piezoelectric speaker, the extension and contraction motion of the piezoelectric element is converted into the bending motion of the diaphragm through the above-mentioned process, whereby the diaphragm is vibrated finally. Further, in order for the diaphragm to start the vibration motion, a "trigger" for the diaphragm to initially start the bending motion is required.

The above-mentioned point will be described by way of a specific example shown in FIGS. 2A to 2D. FIGS. 2A to 2D are views showing that the piezoelectric speaker in a silent state (no input state) vibrates the diaphragm to start generating voice in four stages in accordance with a time passage.

The piezoelectric speaker includes a piezoelectric element 21, a diaphragm 22, and holding members 23, 24, 25, and 26. The piezoelectric element 21 is attached to the diaphragm 22 in intimate contact therewith so that the extension and contraction motion thereof is transmitted to the diaphragm 22. The holding members 23 to 26 are members having appropriate elasticity, such as silicone rubber, and each one end thereof is attached and fixed to a housing or a cover portion (hereinafter, described as a housing) (not shown). Further, each of the holding members 23 to 26 is bonded to the diaphragm 22 at the other end thereof. That is, the holding members 23 to 26 are positioned between the diaphragm 22 and the housing, thereby holding and fixing the diaphragm 22 to the housing. Simultaneously, due to the elasticity of the holding members 23 to 26, the holding and fixing of the diaphragm 22 is rendered flexible connection, thereby ensuring the degree of freedom at which the diaphragm 22 performs vibration motion to such a degree as to generate voice.

FIG. 2A shows a piezoelectric speaker in an initial state, which is stopped in a silent state, with no voice signal input thereto. Next, FIG. 2B shows a state in which a voice signal starts being input to the piezoelectric speaker and the piezoelectric element 21 starts extending. FIGS. 2B and 2C show that the piezoelectric element 21 extends and the diaphragm 22 also extends along therewith. In the stages shown in FIGS. 2B and 2C, the extension of the diaphragm 22 is absorbed by the deformation of the holding members 23 to 26. However, as the extension of the diaphragm 22 proceeds from FIG. 2B to FIG. 2C, reaction forces RF1 and RF2 from the holding members 23 to 26 also increase. In the stage shown in FIG. 2D, the reaction forces RF1 and RF2 from the holding members 23 to 26 become larger than the force by which the diaphragm 22 tries to extend, and the force of the diaphragm 22 of trying to extend, which is transmitted from the piezoelectric element 21, loses a place to go. The force in the extension direction, which has lost a place to go, causes the diaphragm 22 to bend so as to swell a center portion thereof, and escapes in a perpendicular direction. Thus, the diaphragm 22 starts bending. Thereafter, the extension and contraction motion of the piezoelectric element 21 is continuously converted into the bending motion of the diaphragm 22 to become the vibration motion of the diaphragm 22, whereby voice starts being generated.

As described above, in order for the extension and contraction motion of the piezoelectric element 21 to be converted into the bending and vibration motions of the diaphragm 22, the above-mentioned "trigger" for starting the conversion of the extension motion into the bending motion of the diaphragm 22 is required. Then, in order to allow the bending motion to start from the early stage in which the diaphragm 22 starts the extension operation, a structure of holding the diaphragm 22 with a strong binding force is desired. As the structure of holding the diaphragm 22 with a strong binding force, for example, the elasticity of the holding members 23 to 26 is reduced to be hard holding members in the example shown in FIGS. 2A to 2D. This is because the hard holding member with a small elasticity generates a large reaction force in response to even small deformation, and starts the bending of the diaphragm 22 in the stage in which the extension of the diaphragm 22 is small.

However, the support structure for holding the diaphragm 22 with a strong binding force, the "trigger" is obtained in the early stage, and the bending motion is started quickly. On the other hand, however, the motion of the diaphragm 22 after the start of the bending motion is also blocked, which impairs the sound characteristics of the piezoelectric speaker.

Conversely, when the degree of freedom of the vibration motion of the diaphragm 22 is enhanced considering the sound characteristics, the start of the bending motion in the diaphragm 22 is blocked. Specifically, the start of the vibration of the diaphragm 22 is delayed, whereby the start of the reproduction of voice at a time of the start of the input of a voice signal is delayed. That is, the rising of the voice reproduction becomes dull. Further, when the input of a voice signal is performed with a small volume and sound pressure (amplitude) from the start to the end, the deformation of the piezoelectric element 21 also becomes a small extension and contraction motion. Consequently, the bending motion of the diaphragm 22 does not start until the end, and voice may not be generated until the end.

DISCLOSURE OF THE INVENTION

Problem to be Solved by the Invention

This invention provides a piezoelectric speaker in which bending motion of a diaphragm can be started quickly and motion of the diaphragm after the start of the bending motion is not blocked.

Means to Solve the Problem

This invention is applicable to a piezoelectric speaker including a piezoelectric element that deforms in response to an input signal, a diaphragm that vibrates due to the deformation of the piezoelectric element to generate sound, and a resilient portion that holds at least a part of an outer edge of the diaphragm.

According to an aspect of this invention, the piezoelectric speaker further includes a lock portion that comes into contact with a vibration plane of the diaphragm to lock a part of the diaphragm. The lock portion is in a lock state capable of coming into contact with the diaphragm to block extension of the diaphragm in a state in which the input signal is not input to the piezoelectric speaker, and the diaphragm vibrates while being held by the resilient portion when the lock state is released immediately after an input of the input signal.

The following can be taken as a specific example of the lock portion.

The lock portion includes a ring body which has magnetic property with at least a part of an outer edge thereof being held by the resilient portion and which is capable of pressing a vicinity of the outer edge of the diaphragm from one vibration plane side thereof, and a magnetic body which is held by the resilient portion and is capable of coming into contact with and leaving from another vibration plane in the vicinity of the outer edge of the diaphragm. The ring body and the magnetic body attract each other with a magnetic force and sandwich the diaphragm to obtain the lock state, and the lock state is released when the ring body and the magnetic body are detached from each other due to a vibration of the diaphragm immediately after the input of the input signal.

The magnetic body preferably includes a plurality of rubber magnets divided in a plural number in an outer peripheral direction of the diaphragm. Further, the resilient portion is preferably made of a plurality of pressure-sensitive adhesive tapes divided in a plural number in the outer peripheral direction of the diaphragm, each of the pressure-sensitive adhesive tapes being attached to respective outer peripheral ends of the ring body, the diaphragm, and the rubber magnets, each of the pressure-sensitive adhesive tapes being preferably attached so that there is looseness between an adhesion attachment portion of the ring body and an adhesion attachment portion of the diaphragm, and between the adhesion attachment portion of the diaphragm and an adhesion attachment portion of the rubber magnets. Still further, the diaphragm preferably includes at least one of a concave portion and a convex portion that are engaged with the magnetic body in a portion with which the magnetic body comes into contact.

Effect of the Invention

In the piezoelectric speaker of this invention, in an initial state before an input of a signal, a part of the diaphragm is locked by the lock portion, and after the signal is input and the diaphragm starts bending motion, the lock is released and the diaphragm is vibrated in a free state. Thus, the quick start of the bending motion of the diaphragm and the vibration of the diaphragm with a high degree of freedom and a large amplitude and a large vibration plane can be satisfied. This is because in the initial state, the diaphragm obtains a reaction force with respect to the extension operation of the diaphragm due to the lock by the lock portion to start a bending motion quickly, and after the start of the bending motion, the lock by the lock portion is released to eliminate binding, whereby the amplitude and the vibration plane spread.

BEST MODE FOR EMBODYING THE INVENTION

This invention will be described in detail by way of embodiments with reference to the drawings.

Figure 1:
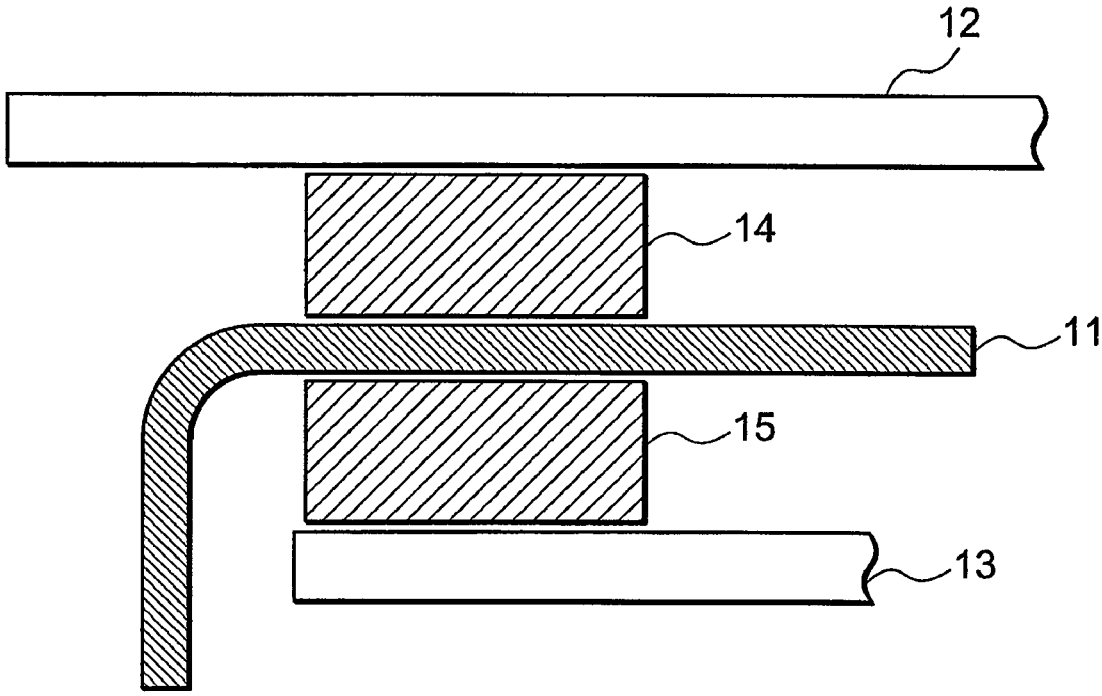
FIG. 1 (RELATED ART)
FIG. 1 is a view schematically showing a configuration of a conventional piezoelectric speaker.
Figure 2A:
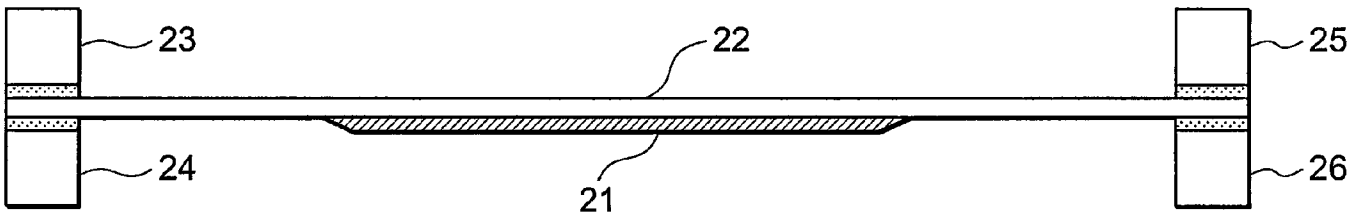
FIG. 2A (RELATED ART)
FIG. 2A is a view illustrating an operation of the conventional piezoelectric speaker.
Figure 2B:
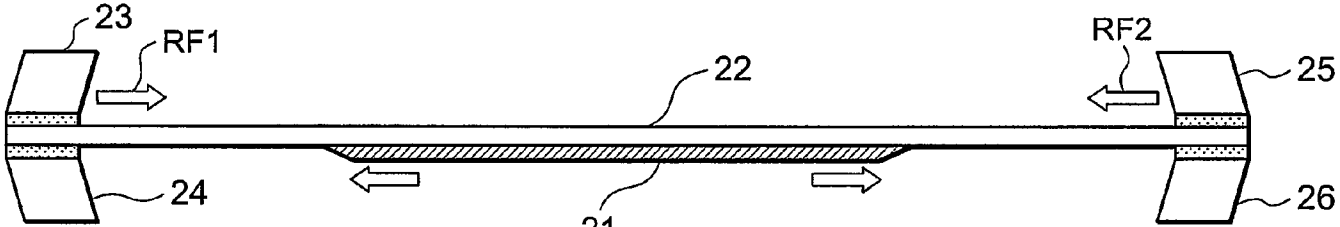
FIG. 2B (RELATED ART)
FIG. 2B is a view illustrating an operation of the conventional piezoelectric speaker continued from FIG. 2A.
Figure 2C:
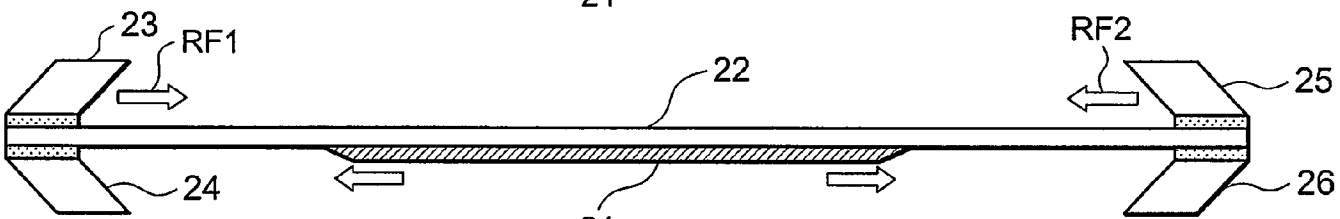
FIG. 2C (RELATED ART)
FIG. 2C is a view illustrating an operation of the conventional piezoelectric speaker continued from FIG. 2B.
Figure 2D:
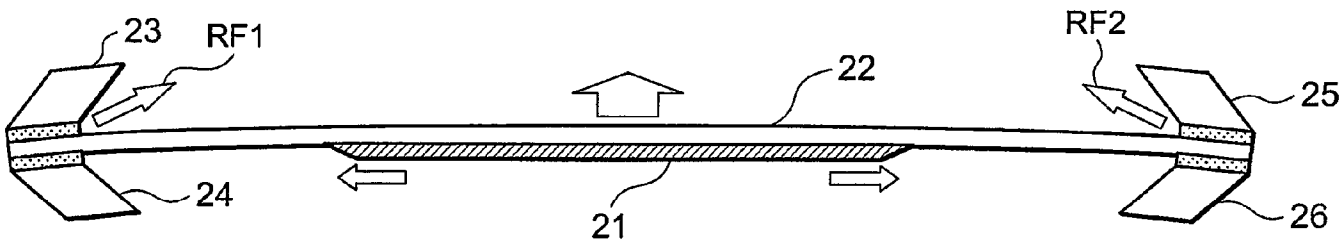
FIG. 2D (RELATED ART)
FIG. 2D is a view illustrating an operation of the conventional piezoelectric speaker continued from FIG. 2C.
Figure 3:
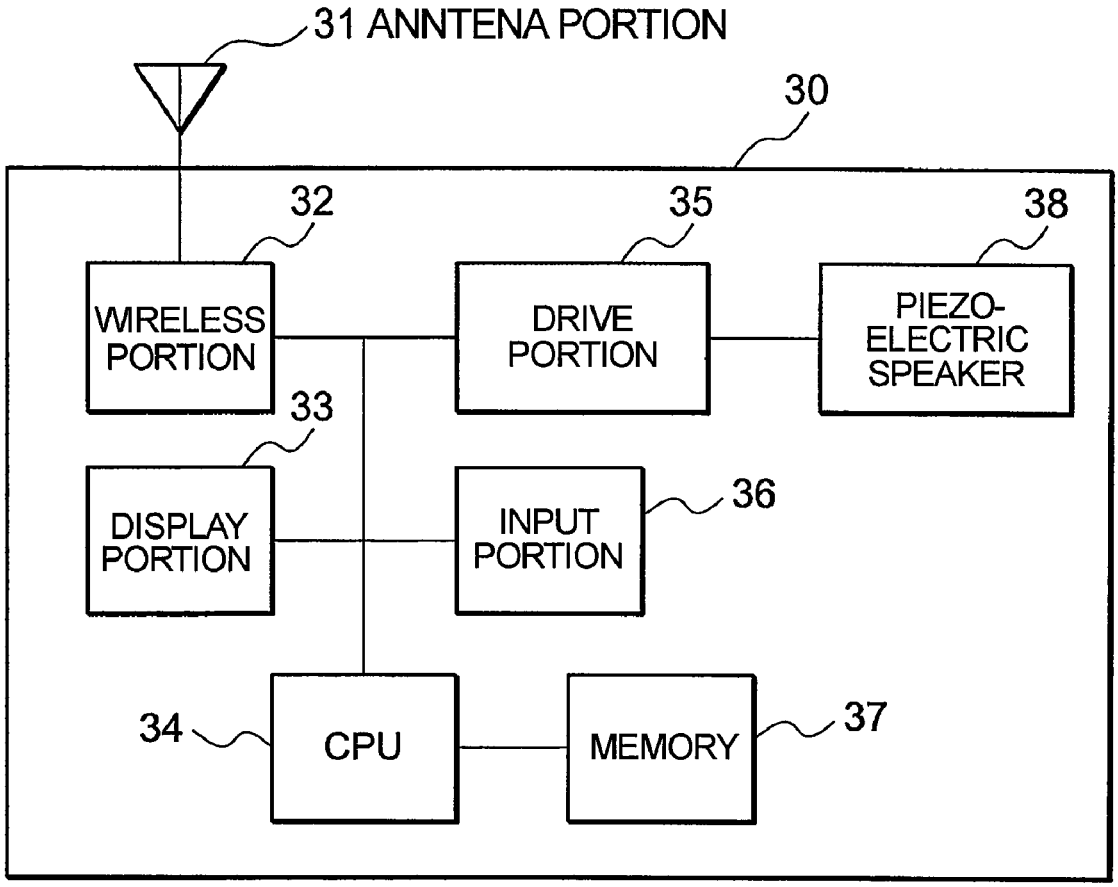
FIG. 3 is a block diagram showing a configuration of a mobile telephone equipped with a piezoelectric speaker according to this invention.

FIG. 3 shows a configuration of a mobile telephone 30 as an example of an electronic apparatus having a piezoelectric speaker 38 according to an embodiment of this invention.

The mobile telephone 30 includes an antenna portion 31, a wireless portion 32, a display portion 33, a central processing unit (CPU) 34, a drive portion 35, an input portion 36, a memory 37, and the piezoelectric speaker 38. In the mobile telephone 30, the piezoelectric speaker 38 is operated, for example, as follows.

The wireless portion 32 receives a radio signal via the antenna portion 31. When the radio signal is, for example, an incoming signal, the CPU 34 displays information on the incoming on the display portion 33 and reads sound data on an incoming sound and an incoming melody stored in the memory 37. The CPU 34 inputs the read sound data in the drive portion 35. The drive portion 35 drives the piezoelectric speaker 38 in accordance with the input sound data, and the piezoelectric speaker 38 generates a sound corresponding to the sound data.

First Embodiment

Figure 4:
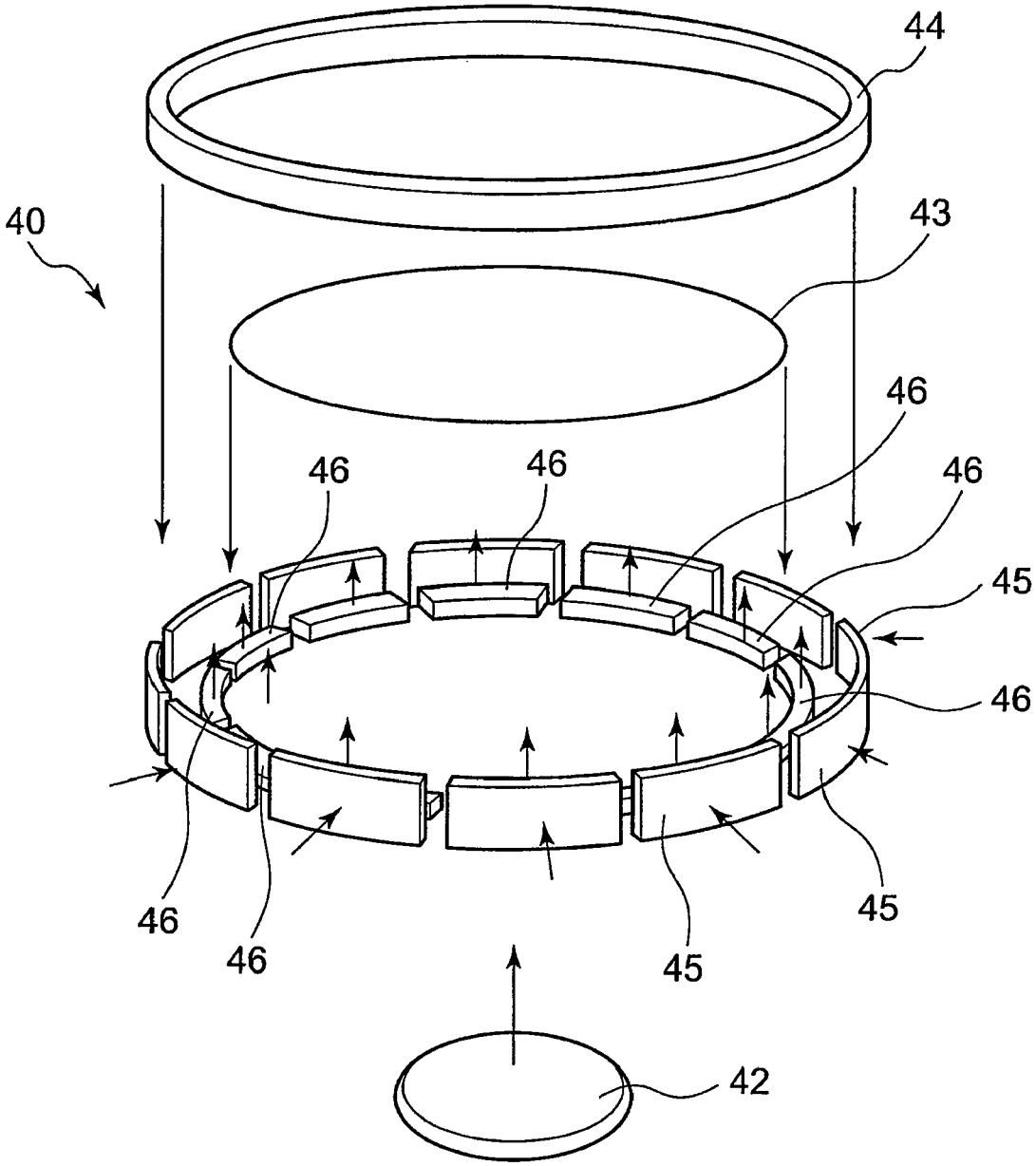
FIG. 4 is an exploded view schematically showing a piezoelectric speaker according to a first embodiment of this invention.

Referring to FIG. 4, the configuration of a piezoelectric speaker according to a first embodiment of this invention will be described. FIG. 4 shows portions, particularly, corresponding to the structure of holding a diaphragm in a piezoelectric speaker according to the first embodiment schematically in an exploded view.

In FIG. 4, a piezoelectric speaker 40 includes a piezoelectric element 42, a diaphragm 43, a fixing ring 44, a plurality of pressure-sensitive adhesive tapes (resilient portions) 45, and a plurality of rubber magnets 46. The piezoelectric speaker 40 is formed of a combination of the respective sites as represented by arrows of FIG. 4. That is, the piezoelectric element 42 is attached to the center of one surface of the diaphragm 43 in contact therewith. Next, the pressure-sensitive adhesive tapes 45 are attached to each outer peripheral end of the diaphragm 43, the fixing ring 44, and the rubber magnets 46. This fixes (locks) the outer edge of the diaphragm 43 so that it is sandwiched between the fixing ring 44 and the plurality of rubber magnets 46.

The fixing ring 44 is made of, for example, metal and has magnetic property. The fixing ring 44 has an integrated structure, whereas the pressure-sensitive adhesive tapes 45 and the rubber magnets 46 are divided in a plural number along the circumference of the fixing ring 44. Further, the pressure-sensitive adhesive tapes 45 have not only an appropriate elasticity but also looseness on the adhesion attachment surface. The rubber magnets 46 are divided in a plural number along the circumference of the fixing ring 44 and held by the pressure-sensitive adhesive tapes 45 with an elasticity, whereby the operation as described later can be performed. In FIG. 4, wiring and the like for applying an electric signal to the piezoelectric element 42 are omitted. Further, similarly to the subsequent figures, unless otherwise required for description, wiring and the like for applying an electric signal to the piezoelectric element 42 are omitted.

Figure 5:
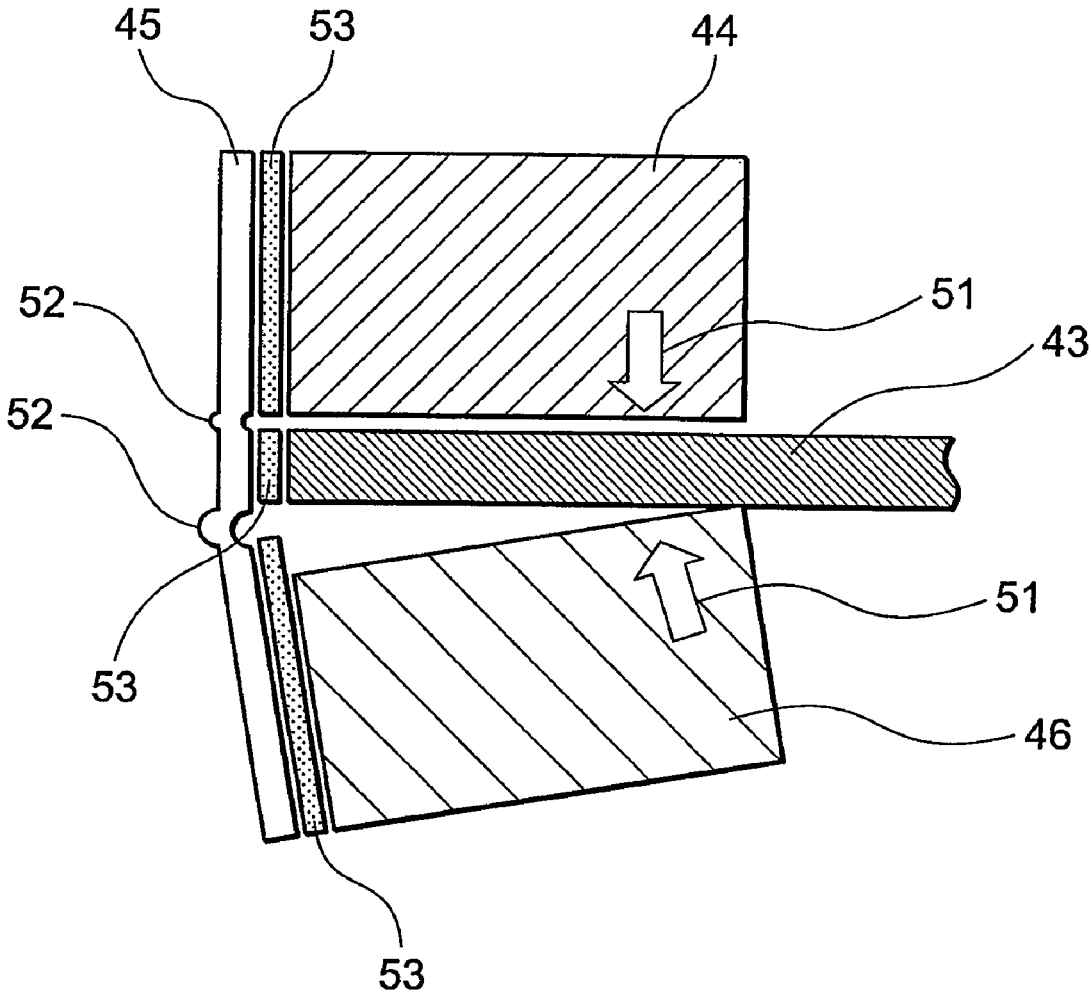
FIG. 5 is a cross-sectional view showing a partially enlarged piezoelectric speaker according to the first embodiment of this invention.

FIG. 5 is a partial cross-sectional view of the assembled piezoelectric speaker 40 shown in FIG. 4. FIG. 5 shows a partially enlarged outer peripheral portion of the piezoelectric speaker 40 shown in FIG. 4. In FIG. 5, components corresponding to those in FIG. 4 are denoted by the same reference numerals as those in FIG. 4.

As shown in FIG. 5, the pressure-sensitive adhesive tapes 45 are attached to each outer peripheral end of the fixing ring 44, the diaphragm 43, and the rubber magnets 46. Reference numeral 53 denotes adhesion attachment portions of the pressure-sensitive adhesive tapes 45, and the pressure-sensitive adhesive tapes 45 are attached to the fixing ring 44, the diaphragm 43, and the rubber magnets 46, respectively, via three adhesion attachment portions 53. Further, the pressure-sensitive adhesive tapes 45 have an appropriate elasticity, and hence gap (play) is present between the fixing ring 44 and the diaphragm 43, and between the diaphragm 43 and the rubber magnets 46 due to a flexure denoted by reference numeral 52. The gap is formed due to the flexure 52, but the fixing ring 44 with magnetic property and the rubber magnets 46 attract each other by a magnetic force indicated by arrows 51 and are fixed (locked) with the diaphragm 43 interposed therebetween. Therefore, the diaphragm 43 is desirably formed of a material that does not interrupt the attraction by the magnetic force between the fixing ring 44 and the rubber magnets 46.

Here, the holding members of the diaphragm in the conventional piezoelectric speakers correspond to the pressure-sensitive adhesive tapes 45. That is, the conventional support structure is a structure of supporting the diaphragm only with the holding members corresponding to the pressure-sensitive adhesive tapes 45. In contrast, the piezoelectric speaker according to the first embodiment additionally includes the fixing ring 44 and the rubber magnets 46, and hence, additionally has a structure of fixing (locking) the diaphragm 43 by sandwiching it between the fixing ring 44 and the rubber magnets 46, unlike the conventional support structure. The piezoelectric speaker assembled as represented by arrows in FIG. 4 is attached to a part of a housing of the piezoelectric speaker via a double-sided tape attached to an upper portion of the fixing ring 44, for example. Alternatively, the whole assembled piezoelectric speaker may be bonded to and housed in a frame formed by molding with an adhesive, and fixed to a part of a housing.

Next, the operation of the piezoelectric speaker 40 according to the first embodiment will be described with reference to FIGS. 6A to 6E. Also in the following, the case where a voice signal is given as an input signal will be described. FIGS. 6A to 6E are cross-sectional views in 5 stages showing the silent stationary state (no input state) of the piezoelectric speaker 40, i.e., the initial state to the state where the piezoelectric speaker 40 vibrates continuously. Further, in FIGS. 6A to 6E, the components corresponding to those in FIG. 4 are denoted by the same reference numerals as those in FIG. 4.

Figures 6A, 6B, 6C, 6D, 6E:
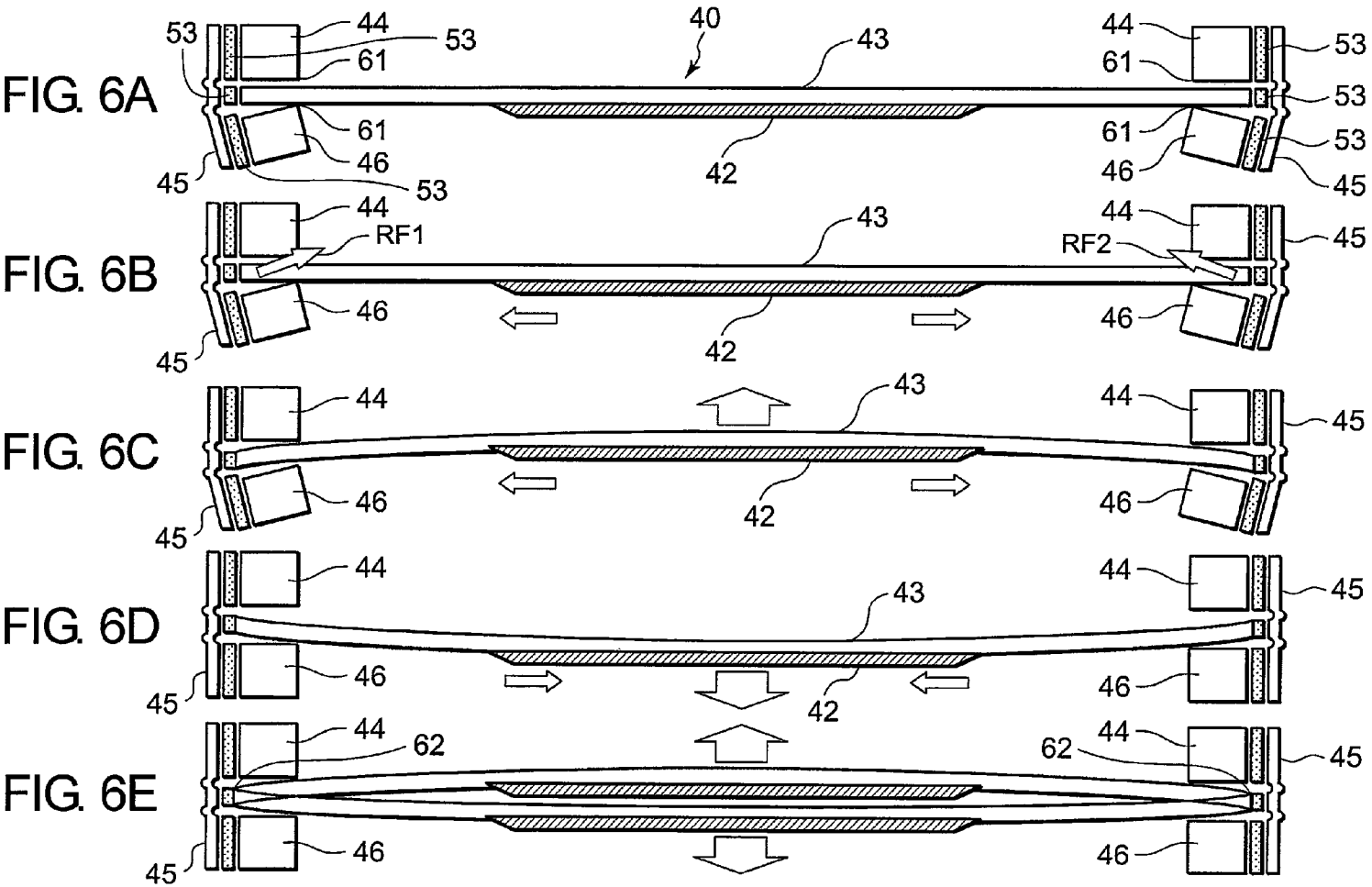
FIG. 6A is a cross-sectional view illustrating an operation of the piezoelectric speaker according to the first embodiment of this invention.
FIG. 6B is a cross-sectional view illustrating an operation of the piezoelectric speaker according to the first embodiment continued from FIG. 6A.
FIG. 6C is a cross-sectional view illustrating an operation of the piezoelectric speaker according to the first embodiment continued from FIG. 6B.
FIG. 6D is a cross-sectional view illustrating an operation of the piezoelectric speaker according to the first embodiment continued from FIG. 6C.
FIG. 6E is a cross-sectional view illustrating an operation of the piezoelectric speaker according to the first embodiment continued from FIG. 6D.

The piezoelectric speaker 40 shown in FIG. 6A shows the same initial state as that of the piezoelectric speaker 40 shown in FIG. 5. That is, the piezoelectric speaker 40 in this stage is in a stationary state or a silent state. At a time shown in FIG. 6B, an electric signal corresponding to a voice signal is applied to the piezoelectric element 42, and the piezoelectric element 42 starts extending. The diaphragm 43 is fixed under the condition of being sandwiched between the fixing ring 44 and the rubber magnets 46; therefore, the extension amount of the diaphragm 43 is smaller than that in the case where the diaphragm 43 is held and fixed only with the pressure-sensitive adhesive tapes 45, which generates reaction forces RF1, RF2 that try to push back the extension. That is, the diaphragm 43 is sandwiched and fixed (locked) by the fixing ring 44 and the rubber magnets 46, whereby the extension of the diaphragm 43 is blocked in an early stage immediately after the application of an electric signal to the piezoelectric element 42, which functions as a "trigger" for converting the extension of the diaphragm 43 to a bending motion. Then, at a time shown in FIG. 6C, the diaphragm 43 starts the bending motion. In this manner, the combination of the fixing ring 44 and the plurality of rubber magnets 46 has a lock function of blocking the extension of the diaphragm 43 immediately after the application of an electric signal, and hence the combination may be called a lock portion.

Next, when the electric signal applied to the piezoelectric element 42 changes to contract the piezoelectric element 42, the diaphragm 43 has already started bending and obtained an impetus of a vibration motion, and hence the diaphragm 43 bends downward as shown in FIG. 6D. The diaphragm 43 bends downward, and hence the fixing ring 44 and the rubber magnets 46 that attract each other due to a magnetic force are detached from each other. When the fixing ring 44 and the rubber magnets 46 are detached to be in a free state, as shown in FIG. 6E, the diaphragm 43 starts a free vibration (bending) motion only with the binding of the elasticity of the pressure-sensitive adhesive tape 45 continuously, thereby generating a voice. That is, the diaphragm 43 is put in a sound state. FIG. 6E shows the diaphragm 43 bending upward in the figure and the diaphragm 43 bending downward in the figure so that they are overlapped for ease of understanding, thereby showing the vibration (bending) motion of the diaphragm 43 schematically.

As shown in FIG. 6E, the diaphragm 43 is bound by only the elasticity of the pressure-sensitive adhesive tape 45, and hence the binding is weaker than that in the states shown in FIGS. 6A to 6C, that is, the state where the diaphragm 43 is sandwiched and fixed between the fixing ring 44 and the rubber magnets 46.

Further, in the states shown in FIGS. 6A to 6C, the vibration of the diaphragm 43 is bound by edges on an inner diameter side of the ring-shaped fixing ring 44 and the rubber magnets 46 as represented by binding points 61 shown in FIG. 6A. Due to the binding by the binding points 61, the vibration of the diaphragm 43 is limited. However, in the state shown in FIG. 6E, the sandwiching (holding) and fixing by the fixing ring 44 and the rubber magnets 46 are released, and hence the diaphragm 43 becomes capable of performing the vibration (bending) motion over the entire surface of the diaphragm 43 with adhesion attachment points 62 with respect to the pressure-sensitive adhesive tapes 45 as pivots. That is, in the state shown in FIG. 6E, the vibration motion can be performed over the vibration plane wider than that in the state shown in FIG. 6A. Therefore, when the piezoelectric speaker 40 is released from the sandwiched state between the fixing ring 44 and the rubber magnets 46, the piezoelectric speaker 40 becomes capable of generating a voice due to the vibration over the wide vibration plane with a higher degree of freedom.

When the application of the electric signal to the piezoelectric element 42 is finished, and the vibration of the diaphragm 43 converges to finish the generation of a voice, the fixing ring 44 and the rubber magnets 46 sandwich and fix the diaphragm 43 again due to the elasticity of the pressure-sensitive adhesive tapes 45 and the magnetic force between the fixing ring 44 and the rubber magnets 46, whereby the state returns to the initial state shown in FIG. 6A.

As described above, before the diaphragm 43 starts the bending motion, the fixing ring 44 and the rubber magnets 46 sandwich and fix the diaphragm 43, thereby giving the reaction forces for starting the bending motion to the diaphragm 43 that tries to extend along with the application of an electric signal as the "trigger". Therefore, even in the early stage of an input of a voice signal to the piezoelectric speaker 40, or to the input of a small voice signal to the piezoelectric speaker 40, the piezoelectric speaker 40 can start the bending motion to generate a voice. Further, after the start of the bending motion, the sandwiching of the diaphragm 43 by the fixing ring 44 and the rubber magnets 46 is released, and the diaphragm 43 can vibrate with a larger degree of freedom, that is, with a weak binding force and a large amplitude by a larger vibration plane.

Further, by variously combining elements such as the number of the rubber magnets 46, i.e., how many rubber magnets 46 divided in an arc shape fix the outer edge of the diaphragm 43, or the magnetic force and weight of the rubber magnets 46, and further the elasticity of the pressure-sensitive adhesive tape 45, the operation and timing of a switching between the fixed state and the released state of the diaphragm 43 can be variously changed.

Second Embodiment

Figure 7:
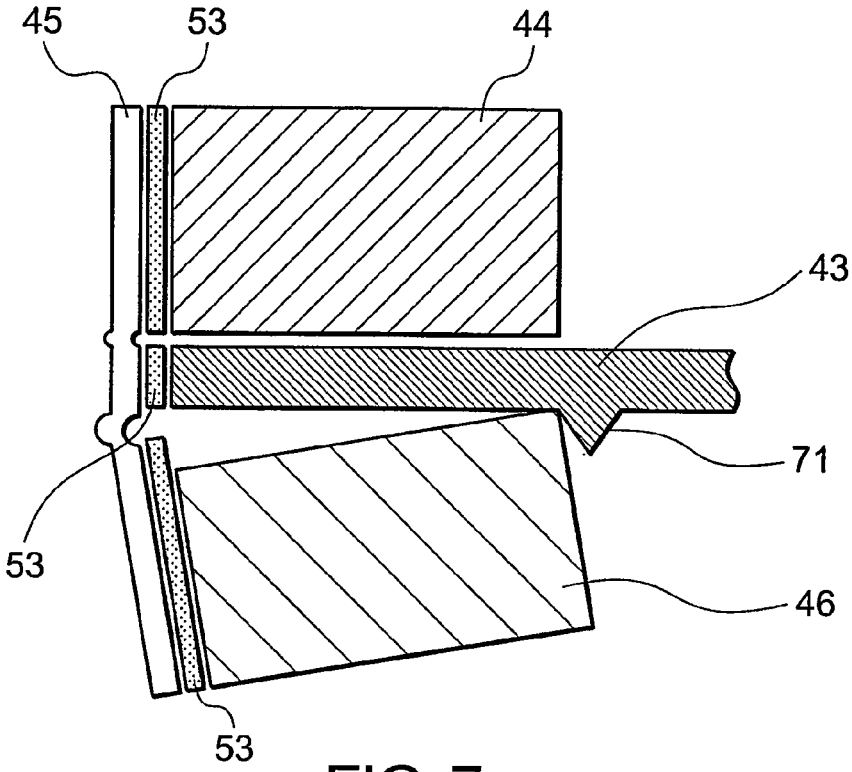
FIG. 7 is a cross-sectional view showing a partially enlarged piezoelectric speaker according to a second embodiment of this invention.

FIG. 7 shows a second embodiment of this invention. FIG. 7 is a view corresponding to FIG. 4, and shows the piezoelectric speaker 40 in a cross-section with an outer edge enlarged partially. In FIG. 7, components corresponding to those shown in FIG. 4 are denoted by the same reference numerals as those in FIG. 4.

In the second embodiment, a convex portion 71 is provided at the diaphragm 43. The convex portion 71 is provided so as to correspond to the position where the rubber magnet 46 is in contact with the diaphragm 43 when the diaphragm 43 is sandwiched and fixed. The convex portion 71 blocks more exactly the motion of the diaphragm 43 that tries to extend to allow a reaction force to be generated, and allows the diaphragm 43 to start a bending motion, whereby the fixed state (lock state) is released.

Further, a slope angle of the convex portion 71 may be varied variously with respect to a contact portion (edge on an inner diameter side) of the rubber magnet 46. For example, if the cross-sectional shape of the convex portion 71 is a triangle as shown in FIG. 7, when the diaphragm 43 extends in a sandwiched and fixed state, it is possible to obtain the function of pushing up the diaphragm 43 perpendicularly with respect to the vibration plane.

Note that, the convex portion 71 may be provided in a ring shape so as to form a complete continuous circle on the vibration plane of the diaphragm 43. Alternatively, the convex portions 71 may be provided discontinuously in portions corresponding to the respective edges of the plurality of rubber magnets 46 in contact with the diaphragm 43.

Third Embodiment

Figure 8:
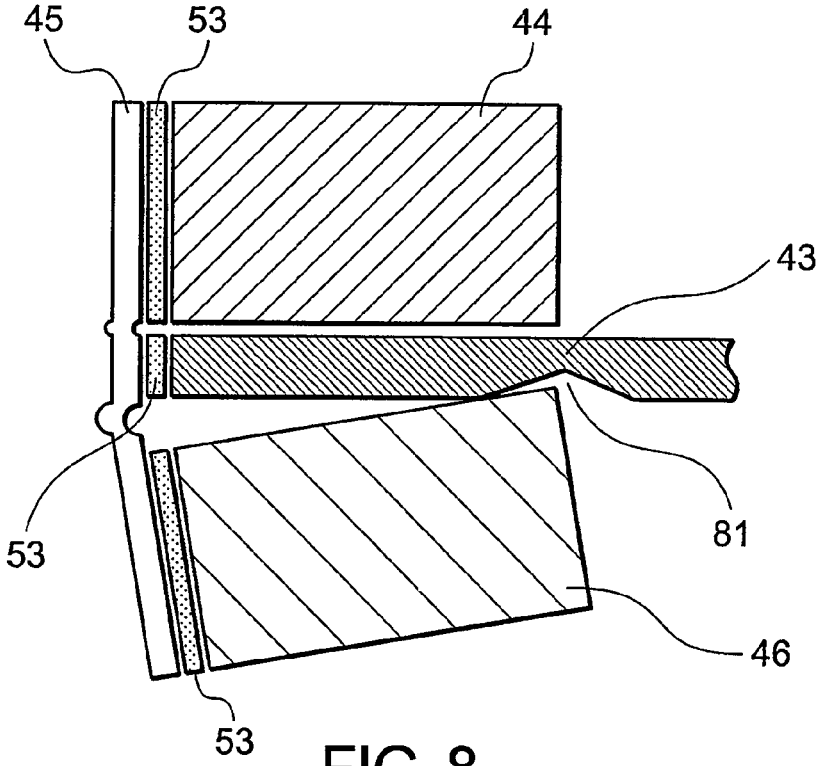
FIG. 8 is a cross-sectional view showing a partially enlarged piezoelectric speaker according to a third embodiment of this invention.

FIG. 8 shows a third embodiment of this invention. In the same way as in FIG. 7, FIG. 8 is also a view corresponding to FIG. 4, and shows the piezoelectric speaker 40 in a cross-section with an outer edge enlarged partially. In FIG. 8, the components corresponding to those shown in FIG. 4 are denoted by the same reference numerals as those in FIG. 4.

In the third embodiment, a concave portion 81 is provided in place of the convex portion 71 in the second embodiment. The concave portion 81 is provided at a position corresponding to an edge of the rubber magnet 46 in the sandwiched and fixed state of the diaphragm 43. Therefore, in the same way as in the second embodiment, the concave portion 81 blocks more exactly the motion of the diaphragm 43 that tries to extend to allow a reaction force to be generated, and allows the diaphragm 43 to start a bending motion, thereby releasing the fixed state (lock state). In the same way as in the second embodiment, a slope angle of the concave portion 81 may be changed variously with respect to an edge of the rubber magnet 46 in a sandwiched and fixed state. For example, as shown in FIG. 8, if the cross-sectional shape of the concave portion 81 is a triangle, when the diaphragm 43 extends in a sandwiched and fixed state, it is possible to obtain the function of pushing up the diaphragm 43 perpendicularly with respect to the vibration plane. In addition, the concave portion 81 can be realized by simple processing of cutting away the vibration plane of the diaphragm 43 partially to form a groove.

Fourth Embodiment

Figure 9B:
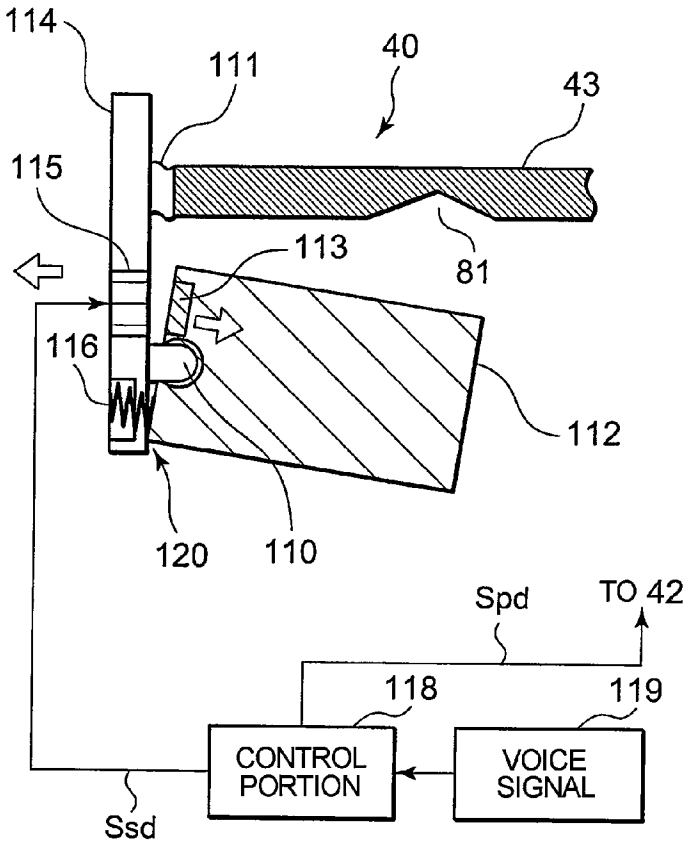
FIG. 9B is an enlarged cross-sectional view showing a part of the piezoelectric speaker according to the fourth embodiment of this invention in the presence of an input of a signal.
Figure 9A:
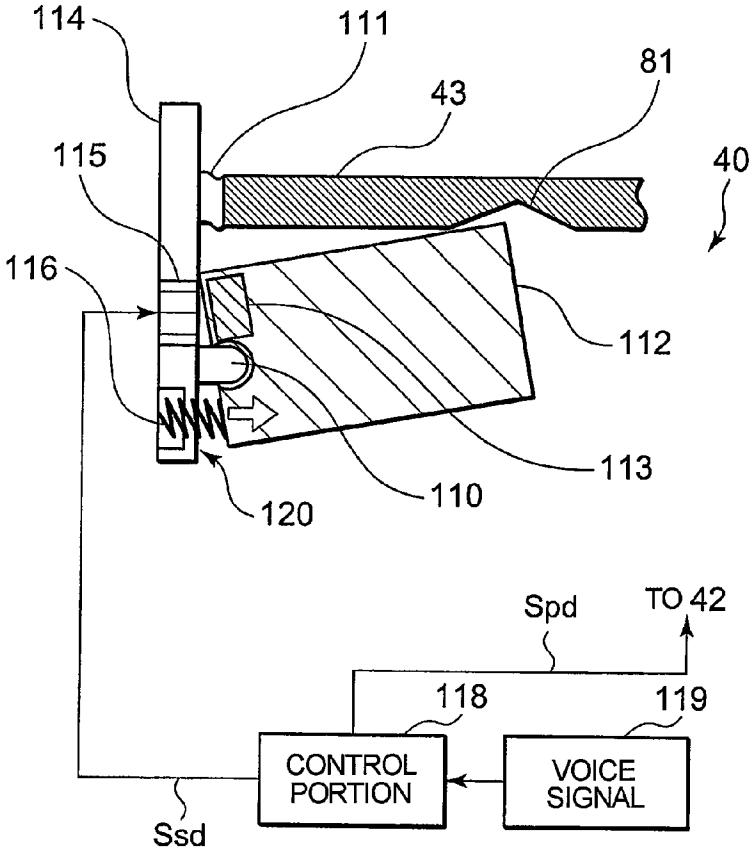
FIG. 9A is an enlarged cross-sectional view showing a part of a piezoelectric speaker according to a fourth embodiment of this invention in the absence of an input of a signal.

FIGS. 9A and 9B show a fourth embodiment of this invention. FIGS. 9A and 9B are views corresponding to FIG. 4, and show the piezoelectric speaker 40 in a cross-section with an outer edge enlarged partially. In FIGS. 9A and 9B, the components corresponding to those in FIG. 4 are denoted by the same reference numerals as those in FIG. 4. Note that, the diaphragm 43 with the concave portion 81 described in FIG. 8 is shown; however, the diaphragm 43 may have the convex portion 71 described in FIG. 7.

Hereinafter, the fourth embodiment will be described based on the difference between the fourth embodiment and the first to third embodiments.

In the piezoelectric speaker 40 in the fourth embodiment, the fixing ring 44 and the pressure-sensitive adhesive tape 45 are not used, and the diaphragm 43 is held by a tubular housing 114 of the piezoelectric speaker by a gathered edge (resilient portion) 111. The gathered edge 111 has an elasticity, which makes it possible for the diaphragm 43 to move freely. A plurality of arc-shaped holding portions 112 are used in place of the fixing ring 44 and the rubber magnets 46 that sandwich and fix the diaphragm 43 in an initial state of the first to third embodiments. The plurality of holding portions 112 have a substantially ring shape as a whole after assembly in the same way as in the rubber magnets 46 described in FIG. 4. In the fourth embodiment, the holding portions 112 are not required to be a magnet as a whole. Instead, the material for the holding portions 112 may have sufficient stiffness and appropriate weight (lightness) with respect to the mechanism and operation described later. The holding portions 112 are not required to have magnetic property as a whole, but the holding portions 112 have a magnet portion 113 at an end opposed to the housing 114. Further, an electromagnetic portion 115 is provided at a position of the housing 114 opposed to the magnet portion 113. The electromagnetic portion 115 generates a magnetic force in a direction repelling the magnet portion 113. The holding portion 112 is a swing body capable of swinging with respect to a fulcrum 110. The housing 114 is provided with a spring portion (elongation spring) 116 symmetric with respect to the electromagnet portion 115 with the fulcrum 110 placed therebetween. The spring portion 116 is biased in a direction of allowing the holding portion 112 to approach the diaphragm 43. The electromagnet portion 115, the spring portion 116, the magnet portion 113, and the fulcrum 110 constitute one rotary electromagnetic switch 120.

The electromagnetic switch 120 is operated by an electromagnetic switch driving signal $S_{sd}$ from a control portion 118. The control portion 118 generates an electric signal that drives the piezoelectric element 42 in the same way as in the drive portion 35 of FIG. 3, and further generates the driving signal $S_{sd}$ of the electromagnetic switch 120 in the fourth embodiment. More specifically, the control portion 118 receives a voice signal 119 and outputs the above-mentioned electromagnetic switch driving signal $S_{sd}$ and a piezoelectric driving signal $S_{pd}$. The piezoelectric driving signal $S_{pd}$ output from the control portion 118 is input to the piezoelectric element 42.

Next, the operation of the piezoelectric speaker according to the fourth embodiment will be described.

FIG. 9A shows an initial state of the piezoelectric speaker 40. In the initial state, the electromagnetic switch 120 is not activated, the holding portion 112 is pressed against the diaphragm 43 by the spring portion 116, and the edge of the holding portion 112 is placed at a first position in which the edge is fitted in the concave portion 81. More specifically, the electromagnetic switch 120 is in a lock state capable of blocking the extension of the diaphragm 43 immediately after the input of a voice signal.

When the voice signal 119 for generating a voice is input to the control portion 118, the control portion 118 outputs the piezoelectric element driving signal $S_{pd}$ in accordance with the input voice signal 119. The output piezoelectric element driving signal $S_{pd}$ is applied to the piezoelectric element 42.

Due to the application of the piezoelectric element driving signal $S_{pd}$, the piezoelectric element 42 starts extending. When the diaphragm 43 tries to extend along with the extension of the piezoelectric element 42, a reaction force is generated in a contact portion between the concave portion 81 and the edge of the holding portion 112 with respect to the extension of the diaphragm 43, which functions as a "trigger" to allow the diaphragm 43 to start a bending motion.

When the diaphragm 43 starts a bending motion, the control portion 118 activates the electromagnetic switch 120 with the electromagnetic switch driving signal $S_{sd}$. When the electromagnetic switch 120 is activated, as shown in FIG. 9B, the electromagnet portion 115 is excited, and the electromagnet portion 115 and the magnet portion 113 repel each other with a force stronger than that of the bias force of the spring portion 116. Thus, the edge of the holding portion 112 swings to a second position so as to be away from the diaphragm 43 with respect to the fulcrum 110. Consequently, the diaphragm 43 is released from the held and fixed state (lock state) made by the holding portion 112, and starts a vibration motion in a free state bound by only the gathered edge 111. Thus, in the fourth embodiment, a combination of the control portion 118 and the electromagnetic switch 120 functions as a lock portion having a lock function of blocking the extension of the diaphragm 43 immediately after the application of an electric signal.

When the generation of a voice is completed, the control portion 118 detects the completion of the generation of a voice from the voice signal 119. When the control portion 118 detects the completion of the generation of a voice, the control portion 118 allows the piezoelectric element driving signal $S_{pd}$ to converge in accordance with the voice signal 119. Further, when the vibration of the diaphragm 43 converges, the control portion 118 turns off the electromagnetic switch 120, and returns the piezoelectric speaker 40 to the state shown in FIG. 9A that is an initial state.

As described above, in the fourth embodiment, the use of the electromagnetic switch 120 allows the control portion 118 to control the holding, fixing, and releasing operations of the diaphragm 43 by the holding portion 112 electrically. Thus, the holding, fixing, and releasing timings of the diaphragm 43 by the holding portion 112 can be controlled more suitably and more minutely. If the control portion 118 is advanced using a CPU and a digital logic circuit, more complicated control of the holding, fixing, and releasing operations of the diaphragm 43 by the holding portion 112 can be performed. For example, the holding, fixing, and releasing operations and the operation timing of the diaphragm 43 by the holding portion 112 may be switched minutely in accordance with the amplitude, frequency, continuation time of a signal, and other signal properties of the voice signal 119 to be input. For example, the control portion 118 may release the diaphragm 43 from a lock state after a predetermined period from the input of a voice signal or when the input voice signal satisfies a predetermined condition. The predetermined condition in this case can be considered to be, for example, that the voice signal has an amplitude larger than a predetermined amplitude.

In the fourth embodiment, the holding portion 112 is biased to the first position where the holding portion 112 comes into contact with the diaphragm 43 using the spring portion 116 by an extension coil spring, and the holding portion 112 is swung to the second position by the reaction force between the magnet portion 113 and the electromagnet portion 115. However, the fourth embodiment may have the following configuration. A compression coil spring is provided in place of the electromagnet portion 115 and the magnet portion 113, whereby the holding portion 112 is swung to the first position with a tensile force of the compression coil spring. On the other hand, an electromagnet portion is provided in the housing 114, and a magnet portion or magnetic body is provided in the holding portion 112, respectively, in place of the spring portion 116. Then, the electromagnet is excited immediately after the input of a voice signal to generate an attraction force therebetween, whereby the holding portion 112 is swung to the second position.

In the first embodiment, the case has been described in which the rubber magnet 46 comes into contact with the vibration plane of the diaphragm 43 at an edge portion (see FIGS. 5 and 6). However, the rubber magnet 46 does not necessarily come into contact with the vibration plane 43 at an edge. For example, the rubber magnet 46 may be provided with a contact plane so that the contact portion between the rubber magnet 46 and the diaphragm 43 becomes a plane, instead of the edge. Further, in order to increase a friction force, the material and surface shape of the contact plane between the rubber magnet 46 and the diaphragm 43 may be varied. For example, the contact plane may be made of a material with a large friction coefficient such as silicone rubber, and the surface shape of the contact plane may be a shape provided with grooves or cut-in, such as a tread pattern of a tire and a sole pattern of shoes, or a shape such as a file.

In the first to third embodiments, the pressure-sensitive adhesive tape 45 is used, but it is not necessary to use a pressure-sensitive adhesive tape as long as the material has an elasticity. For example, those which achieve the free vibration motion of the diaphragm 43 due to the material or structure can be used as in the gathered edge 111 in the fourth embodiment.

Further, in the first to third embodiments, the fixing ring 44 and the rubber magnets 46 attract each other with a magnetic force while sandwiching the diaphragm 43, thereby sandwiching the diaphragm 43 to fix it. However, the fixing ring 44 and the rubber magnets 46 do not necessarily have a structure of sandwiching the diaphragm 43. Even if the fixing ring 44 and the rubber magnets 46 do not sandwich the diaphragm 43, the rubber magnets 46 only need to hold and fix the diaphragm 43 in an initial state, give a reaction force to the extension operation of the diaphragm 43, and promote the start of a bending operation.

Further, in the second to fourth embodiments, the convex portion 71 and the concave portion 81 are provided on the diaphragm 43, but the convex portion 71 and the concave portion 81 may be combined. That is, the first to fourth embodiments can be combined appropriately.

Figure 10:
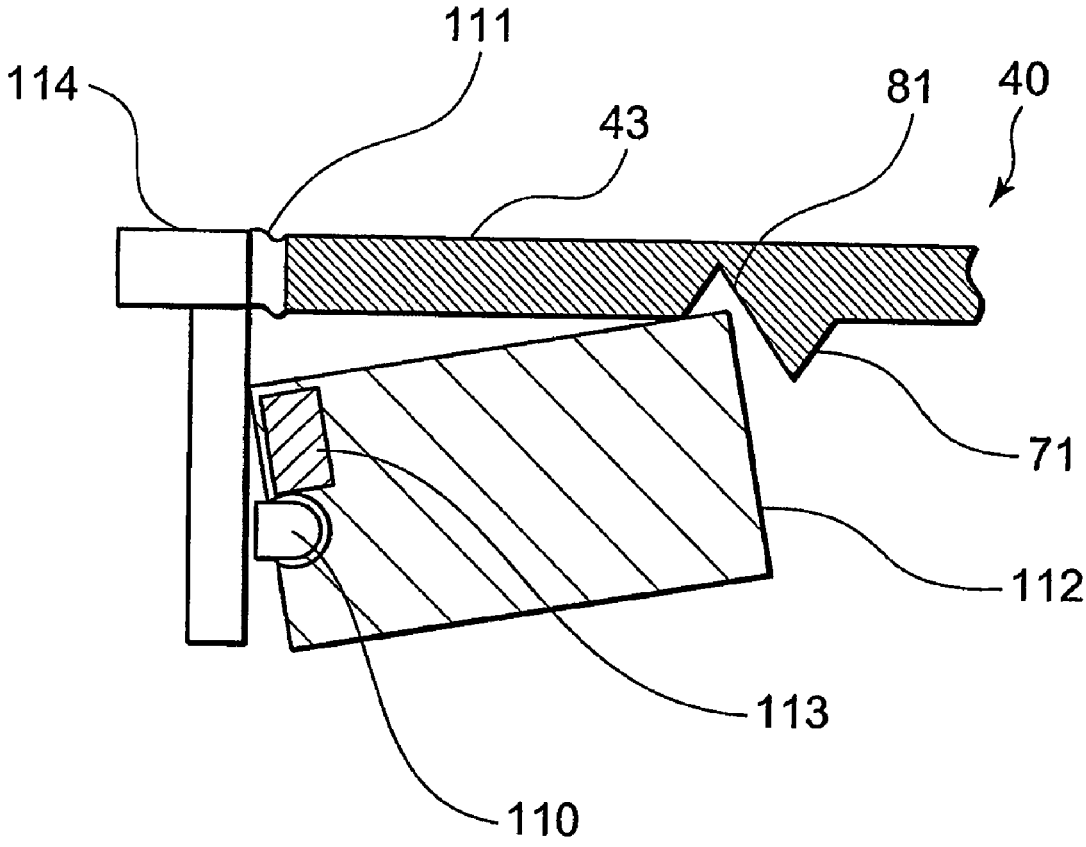
FIG. 10 is a cross-sectional view showing a partially enlarged piezoelectric speaker obtained by combining the second to fourth embodiments.

FIG. 10 shows an example of a combination of the second to fourth embodiments. The piezoelectric speaker 40 shown in FIG. 10 uses the gathered edge 111 in place of the pressure-sensitive adhesive tape 45, has a configuration of holding and fixing the diaphragm 43 with the holding portion 112 instead of the configuration of sandwiching the diaphragm 43 between the fixing ring 44 and the rubber magnets 46, and is provided with a combination of the convex portion 71 and the concave portion 81. In the piezoelectric speaker 40 shown in FIG. 10, the entire housing 114, or a part of the position of the housing 114 corresponding to the magnet portion 113 has magnetic property. Then, the magnet portion 113 and the portion of the housing 114 having magnetic property attract each other with a magnetic force, whereby the holding portion 112 swings, whereby the diaphragm 43 is held and fixed by the holding portion 112. When the diaphragm 43 is bent downward immediately after the application of an electric signal, the housing 114 and the magnet portion 113 attracting each other with a magnetic force are detached from each other. When the magnet portion 113 is detached from the housing 114 to release the diaphragm 43, the diaphragm 43 starts a free vibration (bending) motion continuously, bound by only the elasticity of the gathered edge 111.

In the above description, a mobile telephone is exemplified as electronic equipment with the piezoelectric speaker of this invention, but this invention is also applicable to portable electronic equipment such as a PDA and a portable game appliance.

As described above, the piezoelectric speaker and the electronic equipment provided with a piezoelectric speaker according to this invention sandwiches (holds) and fixes the diaphragm in an initial state and releases the sandwiching (holding) and fixing of the diaphragm after an electric signal is applied and the diaphragm starts a bending motion. This enables the start of the rapid bending motion of the diaphragm, and the vibration of the diaphragm with a large amplitude and a large vibration plane.

According to this invention, a piezoelectric speaker has an effect of enabling the generation of a voice at the start of an input of a voice signal and at a rising of the voice signal, the generation of a voice due to the vibration of a diaphragm with a large amplitude and a large vibration plane, and the generation of a minute voice signal, and electronic equipment provided with a piezoelectric speaker having the effect is realized. Needles to say, the function is completely the same even with a sound signal such as an alarm and an incoming melody, as well as a voice signal.

The invention claimed is:

1. A piezoelectric speaker comprising a piezoelectric element that deforms in response to an input signal, a diaphragm that vibrates due to the deformation of the piezoelectric element to generate sound, and a resilient portion that holds at least a part of an outer edge of the diaphragm, wherein the piezoelectric speaker further comprises a lock portion that comes into contact with a vibration plane of the diaphragm to lock a part of the diaphragm, the lock portion being switched between a lock state and a release of the lock state in accordance with presence or absence of an input of the input signal to the piezoelectric speaker.

2. A piezoelectric speaker according to claim 1, wherein the lock portion is in a lock state capable of coming into contact with the diaphragm to block extension of the diaphragm in a state in which the input signal is not input to the piezoelectric speaker, and the diaphragm vibrates while being held by the resilient portion when the lock state is released immediately after an input of the input signal.

3. A piezoelectric speaker according to claim 2, wherein the lock portion includes:

a ring body which has magnetic property with at least a part of an outer edge thereof being held by the resilient portion and which is capable of pressing a vicinity of the outer edge of the diaphragm from one vibration plane side thereof; and a magnetic body which is held by the resilient portion and is capable of coming into contact with and leaving from another vibration plane in the vicinity of the outer edge of the diaphragm; the ring body and the magnetic body attract each other with a magnetic force and sandwich the diaphragm to obtain the lock state; and the lock state is released when the ring body and the magnetic body are detached from each other due to a vibration of the diaphragm immediately after the input of the input signal.

4. A piezoelectric speaker according to claim 3, wherein: the magnetic body includes a plurality of rubber magnets divided in a plural number in an outer peripheral direction of the diaphragm; and the resilient portion is made of a plurality of pressure-sensitive adhesive tapes divided in a plural number in the outer peripheral direction of the diaphragm, each of the pressure-sensitive adhesive tapes being attached to respective peripheral ends of the ring body, the diaphragm, and the rubber magnets, each of the pressure-sensitive adhesive tapes being attached so that there is looseness between an adhesion attachment portion of the ring body and an adhesion attachment portion of the diaphragm, and between the adhesion attachment portion of the diaphragm and an adhesion attachment portion of the rubber magnets.

5. A piezoelectric speaker according to claim 3, wherein the diaphragm includes at least one of a concave portion and a convex portion that are engaged with the magnetic body in a portion in which the diaphragm comes into contact with the magnetic body.

6. A piezoelectric speaker according to claim 1, wherein: the lock portion includes: an electromagnetic switch capable of switching between a state in which the lock portion comes into contact with the vibration plane in an outer edge of the diaphragm and a state in which the lock portion leaves from the vibration plane; and a control portion that is connected to the electromagnetic switch and performs switch control of the electromagnetic switch in accordance with the presence or absence of the input signal; the electromagnetic switch comes into contact with the vibration plane in the state in which the input signal is not input; and the control portion controls the electromagnetic switch so that the electromagnetic switch is switched to the state of leaving from the vibration plane immediately after an input of the input signal.

7. A piezoelectric speaker according to claim 6, wherein: the diaphragm is held by a part of a housing of the piezoelectric speaker via the resilient portion; the electromagnetic switch includes: at least one swing body that is provided in a part of the housing via a fulcrum at a position close to the resilient portion and that is capable of swinging between a first position at which the swing body comes into contact with the vibration plane of the diaphragm and a second position at which the swing body is detached from the vibration plane of the diaphragm; a magnet that is provided in a portion of the swing body opposed to the housing; a spring member that is provided in a part of the housing and is biased in a direction in which the swing body is caused to come into contact with the vibration plane of the diaphragm; and an electromagnet that is provided at a position in a part of the housing opposed to the magnet, and generates a magnetic force in a direction in which the magnetic force repels the magnet; the swing body is placed at the first position at which the swing body comes into contact with the vibration plane by the spring member in the state in which the input signal is not input; and the control portion excites the electromagnet immediately after the input of the input signal to switch the swing body to the second position at which the swing body is detached from the vibration plane to release the lock state.

8. A piezoelectric speaker according to claim 7, wherein the control portion excites the electromagnet to switch the swing body to the second position at which the swing body is detached from the vibration plane after a predetermined period from the input of the input signal or when the input signal satisfies a predetermined condition.

9. A piezoelectric speaker according to claim 7, wherein the diaphragm includes at least one of a concave portion and a convex portion that are engaged with the swing body in a portion in which the diaphragm comes into contact with the swing body.

10. A piezoelectric speaker according to claim 1, wherein: the diaphragm is held by a part of a housing of the piezoelectric speaker via the resilient portion; the lock portion includes: at least one swing body that is provided in a part of the housing via a fulcrum at a position close to the resilient portion and that is capable of swinging between a first position at which the swing body comes into contact with the vibration plane of the diaphragm and a second position at which the swing body is detached from the vibration plane of the diaphragm; and a magnet that is provided in a portion of the swing body opposed to the housing; a portion in the part of the housing opposed to at least the magnet is formed of a magnetic body; the swing body is placed at the first position at which the swing body comes into contact with the vibration plane by attraction between the magnet and the magnetic body in the state in which the input signal is not input; and the swing body is changed to the second position when the magnet and the magnetic body are detached from each other due to the vibration of the diaphragm immediately after the input of the input signal to release the lock state.

11. A piezoelectric speaker according to claim 10, wherein the diaphragm includes at least one of a concave portion and a convex portion that are engaged with the magnetic body in a portion in which the diaphragm comes into contact with the swing body.

12. An electronic device comprising the piezoelectric speaker according to claim 1.

* * * * *